United States Patent [19]

Strohmeier

[11] 4,129,319

[45] Dec. 12, 1978

[54] SKI BINDINGS

[75] Inventor: Helmut Strohmeier, Kapfenberg, Austria

[73] Assignee: Hermann Kastinger, Austria

[21] Appl. No.: 706,943

[22] Filed: Jul. 20, 1976

[51] Int. Cl.[2] ..... A63C 9/16; A63C 11/16

[52] U.S. Cl. ..... 280/615; 36/117; 280/636

[58] Field of Search ..... 280/615, 614, 611, 607, 280/636; 36/117, 125

[56] References Cited

U.S. PATENT DOCUMENTS

| | | | |
|---|---|---|---|
| 2,246,153 | 6/1941 | Wallace | 280/614 |
| 2,247,237 | 6/1941 | Johnson | 280/615 |
| 3,603,606 | 9/1971 | Eie | 280/615 |
| 4,004,823 | 1/1977 | Pyzel et al. | 280/615 |

FOREIGN PATENT DOCUMENTS

| | | | |
|---|---|---|---|
| 980478 | 5/1951 | France | 280/615 |
| 412440 | 12/1945 | Italy | 280/615 |
| 46816 | 8/1929 | Norway | 280/615 |
| 89860 | 7/1937 | Sweden | 280/615 |

*Primary Examiner*—David M. Mitchell

*Attorney, Agent, or Firm*—Hill, Gross, Simpson, Van Santen, Steadman, Chiara & Simpson

[57] ABSTRACT

A ski binding for cross country use wherein two members are provided one for attachment to a ski the other to a ski boot and constructed to be coupled together in assembly. The coupling member for attachment to the boot is fastenable to the front tip of the sole thereof so that when the two members are coupled together the boot may be held in position via its toe and pivoted to and from the coupled members around the toe.

19 Claims, 11 Drawing Figures

SKI BINDINGS

BACKGROUND OF THE INVENTION

The present invention relates to a ski binding for cross-country skiing comprising a first clip for securing to the front part of the underside of a shoe sole and adapted to be locked by a tensioning device to a second clip fixed to an associated ski.

Ski bindings of this type for cross country skiing (compare German Patent No. 557,025 filed Apr. 27, 1932) have the advantage that they do not require side jaws projecting beyond the lateral edges of the associated ski, which considerably aggravates the difficulty of running in deep snow or in frozen ski tracks. They have the drawback however of permitting the boot sole to bend in its forward part only with difficulty by reason of the first clip being secured thereat. This appreciably hinders running, and especially forward striding in steps. In addition, due to the insufficient flexibility of the front part of the boot, folds are formed in the uppers, which result in unpleasant pressure areas on the skier's foot.

A further disadvantage of cross-country ski bindings of this type is the relatively complicated construction of the mechanical locking means and its tendency to jam when penetrated by dirt or ice.

SUMMARY OF THE INVENTION

The object of the present invention is to provide a cross-country ski binding which dispenses with conventional side jaws, is light, mechanically simple in design and reliable in operation, and, while laterally guiding the ski boot in a stable and effective manner also allows the forward part of the boot sole to bend.

This object is achieved according to the invention in such a way that the boot sole is coupled with the first clip only near its tip the remaining part of the sole being liftable from the first clip.

Thus the invention provides a cross-country ski binding in which the ski boot is connected to the ski only at the tip of the boot sole, so that it is possible to raise the boot from the ski not only in the heel region, but also in the front part of the sole without great exertion. This ensures unhindered striding on skiis having the binding without folds forming in the boot uppers.

In a preferred form of embodiment of the cross-country ski binding according to the invention one of the two clips has bent over lateral parts, the other clip being adapted to slip in between the lateral parts, with the first clip projecting beyond the tip of the boot and being formed into a hook. The tensioning means grips the hook and exerts a pull thereon towards the tip of the ski. This has the advantage that all parts of the binding are completely exposed, so that, unlike the case of the bindings of the above mentioned conventional type dirt, ice or snow can be easily removed should these hinder the clamping on of the skiid or locking the first clip to the second clip. The technical design is simple, robust and can be made very light owing to the small demand on material.

In such a preferred form it is of advantage to form the first clip as a wedge- or swallowtail-shaped plate which is fixed to the forwardly projecting part of the boot screws, rive s or the like, or else made integral therewith. Correspondingly, the second clip has bent side parts in the form of at least two pairs of claws, the claw pair leading in the running direction being spaced closer for the reception of the wedge- or swallowtail-shaped plate than the claw pair which trails with respect to the running direction. Hence dirt, ice or snow does not become packed at any point so as to make the clamping on of the ski difficult. Due to the swallowtail design of the first clip foreign matter packed between the claw pairs is removed when the two clips are fitted into each other, so that no hindrance arises in practice.

The tensioning device may comprise a resilient bracket which engages the hook of the first clip, and has one end fixed to the second clip, the other end being suspended on a third clip, fixed to the ski ahead of the second clip. This construction is extremely light in weight with sufficient tension being applied in the direction of the ski tip. It has further the advantage that the bracket can be swung into a plane lying at right angles to the ski sole to form a carrier bracket, so that the carrier does not touch the ski sole and the two running surfaces need not be pressed against each other when being carried.

In a further preferred form of embodiment the invention the tensioning device is provided with a clamping lever which can be snapped into the hook of the first clip, and enables the first clip to be wholly reliably locked with the second clip. The clamping lever of the tensioning device may either extend lengthwise of the ski and be connected with it by a lever mechanism or be formed as a switch member arranged athwart the ski.

In the case of a clamping lever extending along the ski it is advantageous for the lever mechanism to comprise a bellcrank lever, Thus high tension can be obtained with little effort, and once the dead-centre position has been passed secure locking in the closed position can be obtained.

If a tumbler-type clamping lever is provided it is advantageous to equip this with a clamping curve for engaging the hook of the first clip which likewise ensures with little weight high tension and secure retention in the locked position.

For locking or unlocking the first and second clip it is of advantage for the clamping lever to have actuating recesses or actuating bores for inserring the point of a ski stick. In this way the skier can bring the clamping lever of the binding into and out of the locking position simply with the ski stick without stooping during a run.

It is further advantageous for the second clip to be provided with a roof- or wedge-shaped part extending under the boot sole along the ski. In this way the snow that enters during running between the sole and the surface of the ski is pressed out over the faces of the roof- or wedge-shaped clip part which slop outwards. It is thus ensured that after each stride the shoe can be swung back exactly into its initial horizontal position on the ski. Thus no accumulation of snow hindering the return movement of the shoe can form under the sole.

Preferably the shoe sole has at least in the vicinity of the heel a notch fitting the roof- or wedge-shaped part of the clip. This ensures that the shoe in its horizontal initial position, in addition to the lateral guidance provided by the binding, has a further lateral guiding which relieves the binding in this position of the shoe.

BRIEF DESCRIPTION OF THE DRAWINGS

The invention will now be particularly described and explained below for further clarification and better understanding with reference to the attached drawings.

DETAILED DESCRIPTION OF PREFERRED EMBODIMENTS OF THE INVENTION

Figure 1:
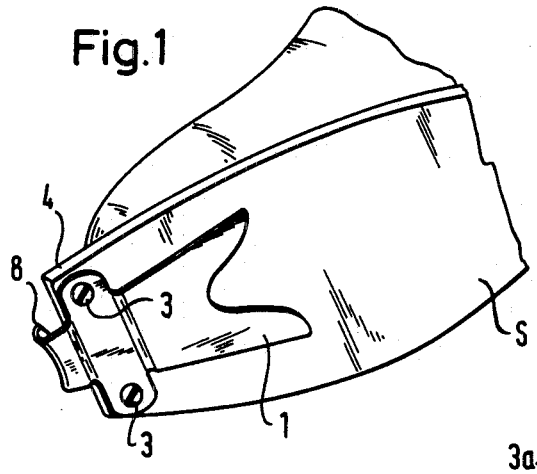
FIG. 1 is a perspective view of a first embodiment of a first clip fixed to the underside of the front part of a boot sole.
Figure 2:
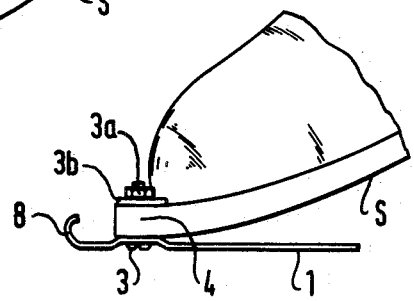
FIG. 2 shows the embodiment according to FIG. 1 in side elevation, FIG. 3 gives a perspective view of a second embodiment of the first clip fixed to the underside of the front part of a boot sole.

FIGS. 1 to 4 of the drawings show a broken-off representation of a first clip 1 or 1*a* which is fixed to the front part of a boot sole S. In FIGS. 1 and 2 the first clip is fastened to the sole S by means of screw-bolts or fasteners 3 associated nuts 3*a* and counter-bearing plate 3*b*, to the forwardly projecting sole part 4, whereas in FIGS. 3 and 4 it is formed integrally with the sole S.

The first clip 1 (FIGS. 1 and 2) which is screwed on to the sole S, and the first clip 1*a*, (FIGS. 3 and 4) formed integrally therewith, are formed as a wedge- or swallowtail-shaped plates, which may be pushed into a second clip 2 fixed to a ski 5. The second clip 2 has bent-over side elements in the form of two pairs of claws 6 and 7, and for the reception of the wedge- or swallowtail-shaped plate the leading claw pair 7 is spaced closer than the trailing claw pair 6.

As will be seen from FIGS. 1 to 4, the first clip 1 or 1*a* projects beyond the boot tip and is bent into a hook 8, which is engaged by a tensioning device in the form of a resilient stirrup 9 (FIGS. 5 and 6), a clamping lever 10 (FIG. 7) extending along the ski, or a tumbler means 11 (FIG. 8) placed across the ski. The tensioning device exerts a pull upon the first clip 1 or 1*a* in the direction of the ski tip, so that this is pulled in between the claw pairs 6 and 7 of the second clip 2 and thus ensures a rigid connection between the first and second clips.

Figure 5:
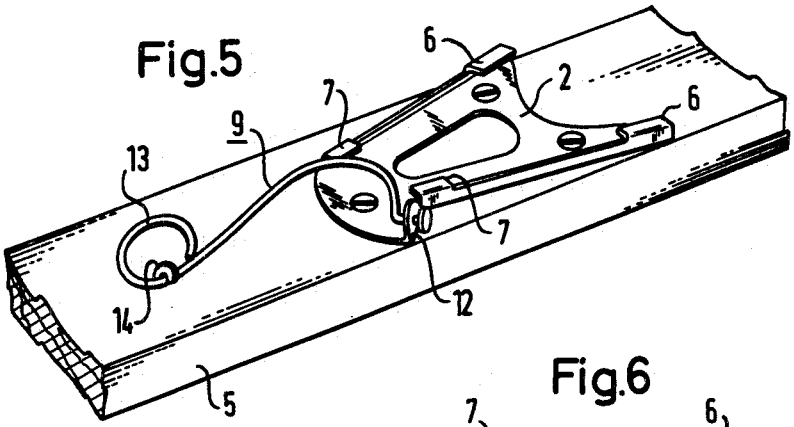
Figure 6:
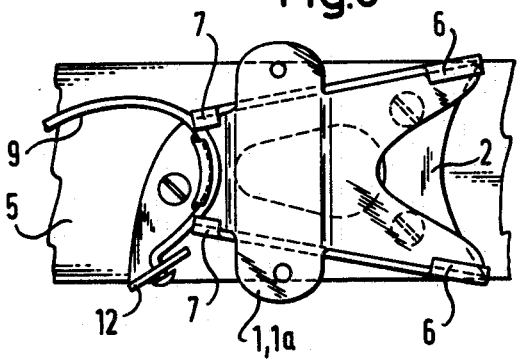
FIG. 6 shows the embodiment according to FIG. 5, partly broken off, with the first clip according to FIGS. 1 and 2 (without the boot) slid into the second clip, FIG. 7 gives a perspective view of a further embodiment of the binding according to the invention comprising a tensioning device with a clamping lever extending along the ski, FIG. 8 gives a perspective view of a further embodiment of the binding according to the invention, comprising a tensioning device with a tumbler-type clamping lever placed athwart the ski.

As will be seen from FIGS. 5 and 6, the resilient stirrup 9 is secured via one end to a flap 12 on the second clip 2. The other end of the stirrup 9 has a ring 13, which can be suspended in a third clip 14 in the form of a hook for example fixed to the ski 5. This presents the advantage that the resilient stirrup 9 serves not only, as illustrated in FIG. 6, as a tensioning device by engaging the hook 8 of the first clip 1 or 1*a*, but is also slewable into a plane at right angles to the surface of the ski 5 to form a carrier bracket. Thus a skier carrying the skis does not have to lay their running surfaces against each other or touch them with his fingers.

Figure 7:
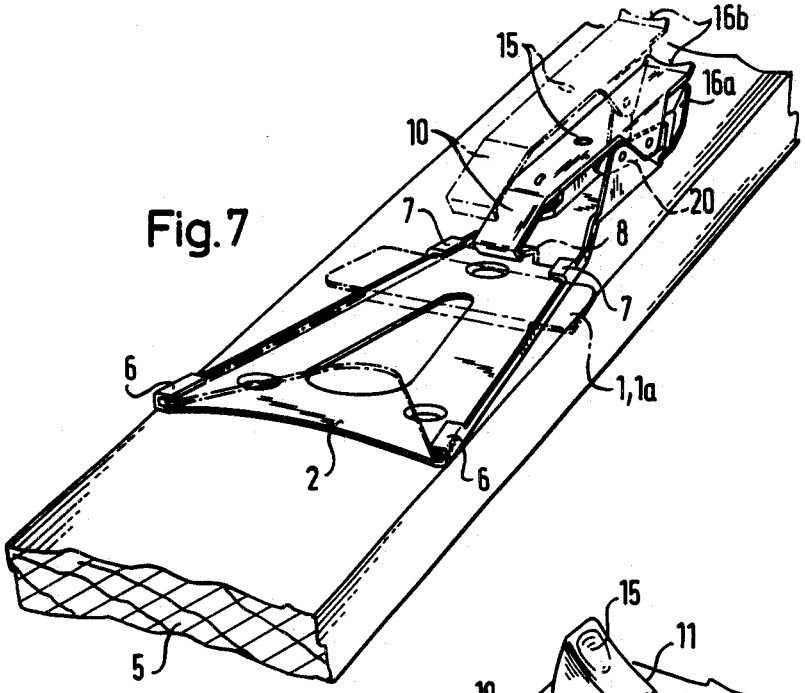
Figure 8:
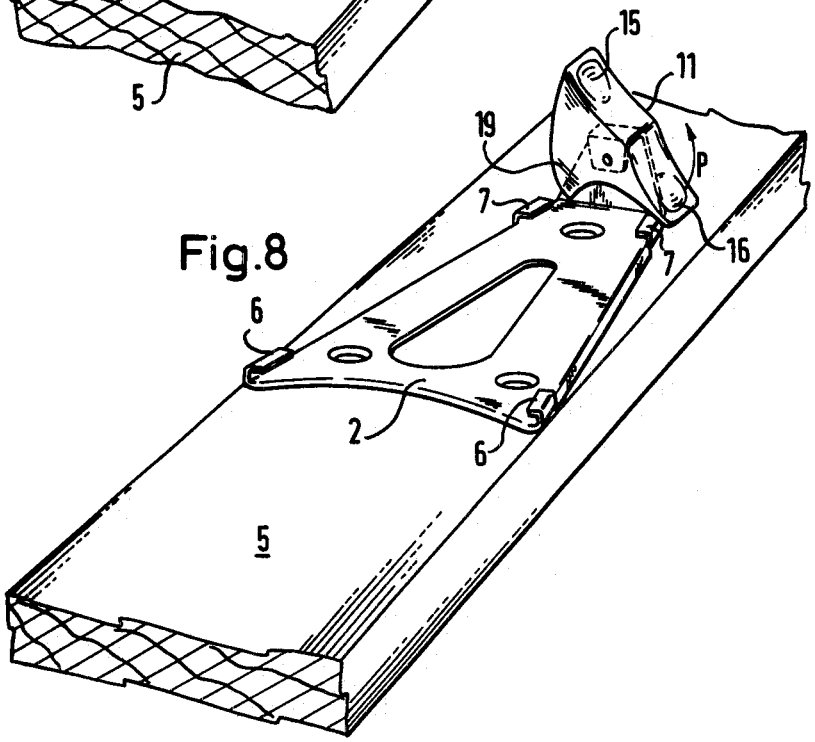

The embodiments illustrated in FIGS. 7 and 8 are provided with tensioning devices having a clamping lever 10 or 11 which can be snapped into the hook 8 of the first clip 1 or 1*a*.

Whereas the clamping lever 10 of the embodiment shown in FIG. 7 extends along the ski and is connected with the second clip 2 by a bellcrank lever 20 the clamping lever 8 illustrated in FIG. 8 has the form of a tumbler means 11 placed across the ski. The tumbler means 11 has on its rear side corresponding to the leading direction of the ski 5 a nose 19 which is formed as a tensioning curve, having a variable thickness in the longitudinal direction of the ski. If the first clip 1 or 1*a* is slipped into the second clip 2 and the tumbler means is turned in the direction of the arrow P the nose 19 grips behind the hook 8 of the clip 1 or 1*a* and pulls it in the leading direction between the claw pairs 6 abd 7. The clip 1 or 1*a* is thus rigidly locked to the clip 2 on the ski.

The automatic return of the tumbler means 11 when loaded in the direction opposite to the arrow P can be prevented by a suitable design of the nose 19 to be the tensioning curve or by providing a catch (not shown). The nose 19 thus provides the clamping curve for coaction with the hook 8.

The clamping lever 10 and the tumbler means 11 have actuating recesses or depressions 15 and 16 for the insertion of a ski-stick tip. In the example of embodiment according to FIG. 8 for locking the binding the ski stick is inserted with its point into the recess 15 in the tumbler means 11, which is tipped over in the direction of the arrow P. The disengagement of the binding is effected by inserting the point of the ski stick into the recess 16 and tilting the tumbler means 11.

Locking of the arrangement shown in FIG. 7 is effected by inserting the point of a ski stock into the bore 15 on the top side of the clamping lever 10. For releasing the lock the point of a ski stick may be inserted into the cap-like recess 16*a* at the front end of the clip 2, and the ski stock tilted in the leading direction of the ski 5. In this way the ski stick comes into engagement with the recess 16*b* of the clamping lever 10, whereby this is raised into the position shown by broken lines in FIG. 7. The clamping lever 10 is then retained in this position by the action of a small spring (not shown) until a further locking operation is required.

Figure 3:
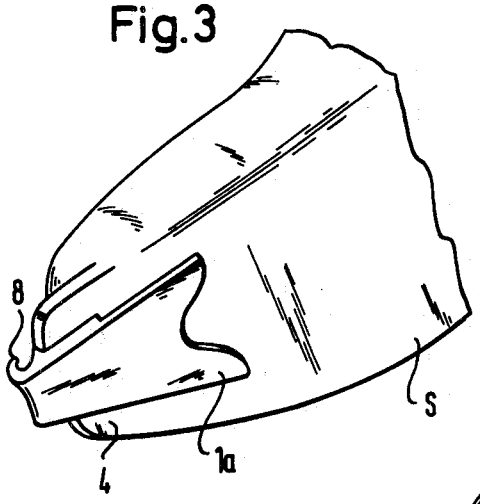
Figure 4:
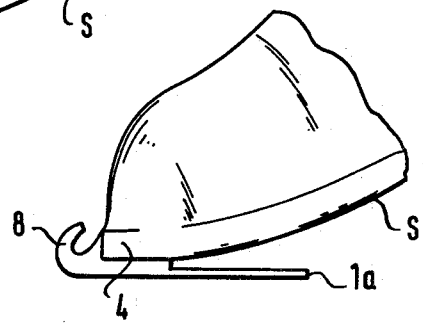
FIG. 4 shows the embodiment according to FIG. 3 in side elevation, FIG. 5 gives a perspective view of the second clip fixed to the ski with a tensioning device.

As will be seen more particularly from FIGS. 3 and 4, the ski binding shown allows the shoe to be rounded on the sides, so that the sole S can be kept very narrow. This prevents braking action by laterally projecting parts. The integral form of the first clip 1*a* with the boot sole, further provides an additional saving on weight and a reduction of the production costs.

Figure 10:
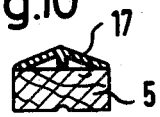
FIGS. 10 and 11 show cross sections along the plane A-B and C-D respectively of the FIG. 9.
Figure 11:
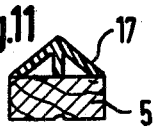
Figure 9:
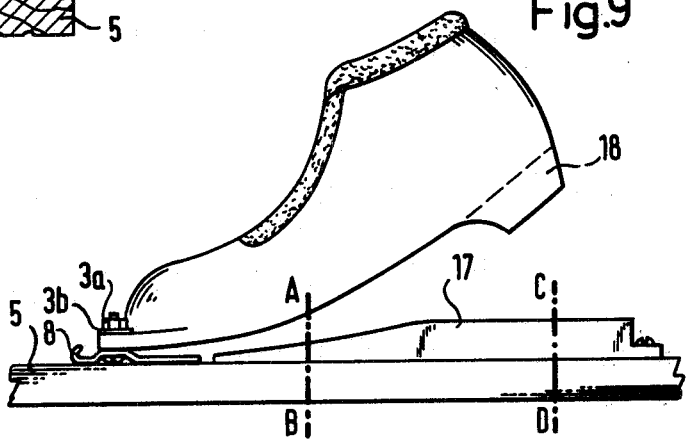
FIG. 9 shows in side elevation a roof- or wedge-shaped clip member extending longitudinally under the boot sole.

As seen from FIGS. 9 to 11, the second clip 2 has a member 17 which extends lengthwise under the boot sole S and has a roof or wedge shape. Owing to the roof-wise inclined side surfaces of this clip member 17, the snow penetrating under the boot sole in the running is pressed out to the sides, so that no accumulation of snow can harden under the boot sole. Thus even in unfavourable snow conditions the boot can always be brought back into its horizontal starting position.

In the example of embodiment shown in FIG. 9 the boot sole has about the heel a notch 18, which exactly fits the roof- or wedge-shaped member of the clip 17. As a result the boot in being slewed into its horizontal starting position is exactly aligned laterally with the longitudinal direction of the ski and the binding in this position of the boot is, therefore, relieved from side stresses.

What I claim is:

1. For use with a cross country ski boot and a ski, the improvement comprising a cross country ski binding for coupling the ski boot to the ski and comprising a first clip for attachment to a leading projecting tip of the boot, the first clip having a hook at its forwardmost end to be positioned forward of said boot tip and having a rearward end extending beneath the boot sole rearwardly of said boot tip, means for securing the first clip to the boot with said means being located rearwardly of said hook, said first clip having generally converging side edges with said edges converging in a direction extending towards the boot tip but underlying the boot, said securing means attaching said first clip to the boot only at the projecting tip of the boot, a second clip, means for rigidly securing the second clip to the ski, said second clip comprising a relatively flat piece of metal having opposite edges converging in a direction towards a forward tip end of the ski and claws extending upwardly from the edges away from the ski and inwardly in overlying retaining engagement with said converging side edges of said first clip and in slidable assembly relative to said claws, and a tensioning device mounted on said ski generally forward of both of said clips and engageable with said hooked end of said first clip and exerting a pull upon the first clip in a direction of the ski tip so that said first clip is pulled in between the claws of the second clip thus insuring a rigid connection between the first and second clips, the interengagement between the clips and the interengagement between said first clip and said boot tip being such as to permit the boot to pivot on said boot securing means free of said first and second clips whereby the heel of the boot can be lifted free of the clips and the ski while the forward boot tip is securely held to the ski.

2. The improvement according to claim 1, wherein said first clip is formed in cross-section as a wedge-or swallow tail-shaped plate.

3. The improvement according to claim 2, wherein said first clip comprises a plate, provided with fasteners for securing the first clip to said tip of the boot.

4. The improvement according to claim 3, wherein a plate member of sheet metal is provided substantially corresponding in form to and adapted to lie over said projecting tip to form a counter bearing for said fasteners.

5. The improvement according to claim 3, wherein said plate is formed integrally said boot sole.

6. The improvement according to claim 3, wherein said claws are arranged in at least two pairs with the leading claw pair being spaced closer to one another than the succeeding trailing claw pair for reception of the wedge- or swallow tail-shaped plate forming said first clip.

7. The improvement according to claim 4, wherein the tensioning device comprises a resilient stirrup for engaging said hook of said clip, one end of said stirrup being attached to said second clip, its other end being suspended on a third clip member attachable to the ski.

8. The improvement according to claim 7, wherein said stirrup is attached to said second clip for slewable movement into a plane at right angles to the surface of the ski to form a carrier for carrying the ski.

9. The improvement of claim 6, wherein the tensioning device includes a clamping lever movable into tensioned engagement with said hook.

10. The improvement according to claim 9, wherein said clamping lever is mountable to extend longitudinally of the ski and for connection thereto by lever means.

11. The improvement according to claim 10, wherein said lever means is a bellcrank lever.

12. The improvement according to claim 9, wherein said clamping lever has a tumbler means for pivoting upon a longitudinal axis the ski securing the hook in tensioned assembly on the ski.

13. The improvement according to claim 12, wherein said tumbler means is equipped with a pivotally mounted clamping curve for releasable engagement with said hook.

14. The improvement according to claim 11, wherein said bellcrank lever has actuating recesses or bores for receiving the point of a ski stick.

15. The improvement according to claim 14, wherein said second clip has a clip member for extending under the boot sole and along the ski, said clip member having a wedge shape in a vertical transverse plane.

16. The improvement according to claim 15, wherein said clip member is provided for engagement with a notch formed at least in the region of the heel of the boot.

17. In combination, a cross country ski boot, a ski, a cross country ski binding for coupling said ski boot to said ski and comprising a first clip attached to a leading projecting tip of said boot, the first clip having a hook at its forwardmost end positioned forward of said boot tip and having a rearward end extending beneath the boot sole rearwardly of said boot tip, means for securing the first clip to said boot with said means being located rearwardly of said hook, said first clip having generally converging side edges with said edges converging in a direction extending towards the boot tip but underlying the boot, said securing means attaching said first clip to the boot only at the projecting tip of the boot, a second clip, means rigidly securing the second clip to the ski, said second clip comprising a relatively flat piece of metal having opposite edges converging in a direction towards a forward tip end of the ski and claws extending upwardly from the edges away from the ski and inwardly in overlying retaining engagement with said converging side edges of said first clip and in slidable assembly relative to said claws, and a tensioning device mounted on said ski generally forward of both of said clips and engageable with said hooked end of said first clip and exerting a pull upon the first clip in a direction of the ski tip so that said first clip is pulled in between the claws of the second clip thus insuring a rigid connection between the first and second clips, the interengagement between the clips and the interengagement between said first clip and said boot tip being such as to permit the boot to pivot on said boot securing means free of said first and second clips whereby the heel of the boot can be lifted free of the clips and the ski while the forward boot tip is securely held to the ski.

18. The combination of claim 17, further characterized by the tensioning device including a tumbler means mounted on the ski and pivotable on a longitudinal axis for securing the hook in tensioned assembly upon the ski, said tumbler means having a pivotally mounted clamping curve pivotably engageable with said hook to hold the hook in tensioned assembly therewith.

19. The combination according to claim 17, wherein said second clip has a clip member for extending under the boot sole and along the ski, said clip member having a wedge shape in a vertical transverse plane.

* * * * *